United States Patent [19]

Borg

[11] 4,368,255

[45] Jan. 11, 1983

[54] METHOD OF PROCESSING MONOCHROME SILVER HALIDE MATERIAL

[75] Inventor: Thomas G. Borg, Brentwood, England

[73] Assignee: Ciba-Geigy AG, Basel, Switzerland

[21] Appl. No.: 283,420

[22] Filed: Jul. 15, 1981

[30] Foreign Application Priority Data

Jul. 16, 1980 [GB] United Kingdom ..... 8023175

[51] Int. Cl.[3] ..... G03C 7/00

[52] U.S. Cl. ..... 430/351; 430/382; 430/388; 430/386; 430/467; 430/544; 430/549

[58] Field of Search ..... 430/382, 544, 549, 351, 430/17, 388, 386, 467

[56] References Cited

U.S. PATENT DOCUMENTS

| | | | |
|---|---|---|---|
| 2,454,001 | 11/1948 | Mueller | 430/382 |
| 3,632,373 | 1/1972 | O'Connell et al. | 430/549 |
| 3,703,375 | 11/1972 | Groet et al. | 430/549 |
| 3,756,821 | 9/1973 | Hayashi et al. | 430/382 |
| 3,932,185 | 1/1976 | Matsuura | 430/549 |
| 4,063,950 | 12/1977 | Fujiwhara et al. | 430/382 |
| 4,286,054 | 8/1981 | Englemann et al. | 430/382 |

*Primary Examiner*—J. Travis Brown

*Attorney, Agent, or Firm*—Joseph G. Kolodny

[57] ABSTRACT

A method of processing monochrome silver halide material which contains in at least one silver halide layer in addition to the normal image-forming color coupler or couplers a development inhibitor releasing compound which method comprises developing the exposed material in a color developing solution which comprises not more than 2.5 g/liter of a paraphenylene diamine color developing agent which is able to couple with the color coupler or couplers and D.I.R. compound present, the process further comprising silver halide fixing, silver image bleaching and washing steps. The developed photographic images exhibit a remarkable increase in sharpness.

9 Claims, No Drawings

METHOD OF PROCESSING MONOCHROME SILVER HALIDE MATERIAL

The present invention relates to a method of processing monochrome silver halide material and thus to the production of monochromatic dye images.

In normal colour photography it is usual to produce three colour images by an imagewise exposure and colour development of colour photographic material, there being in at least one layer of cyan image, in at least one layer a yellow image and in at least one layer a magenta image. These images when viewed together in the colour tripack combine to form either a positive colour reproduction of the original or a negative colour reproduction of the original which can be used to produce a positive colour reproduction of the original, depending on the colour photographic material used. However other colour photographic material is known, the object of which, after colour development, is to produce a monochromatic reproduction of the original, that is to say a single dye image of the original like a silver image, rather than the composite three dye image produced in colour photographic material. This material is hereinafter referred to as monochrome silver halide material.

The object of forming a monochromatic dye image rather than a silver image is to produce an almost grainless image which can be used for enlarging purposes. There is also the added advantage that all the silver present in the silver halide material which is exposed can be recovered as none is present in the processed material.

Photographic material which yields a monochromatic image is described for example in GB No. 490.517 and GB No. 492518. In both these specifications the invention lay in the production of black or at least dark grey monochromatic dye images which could be used for enlarging purposes. However normal silver halide photographic enlarging paper is not fully colour sensitised and thus is sensitive only to blue-green light so that it can be used under yellow safelight conditions. Thus in monochrome silver halide material of use for enlargement purposes it is required only that a yellow-orange image be produced as this image will absorb blue-green light. Nevertheless it is often desirable to produce in conjunction with the yellow-orange image another dye image to form an image which is easier for the operator to see and use for picture composing and focussing in darkroom conditions. Such a composite image formed from two or more dyes in the same layer is called in this specification a monochromatic image to distinguish it from the tri-colour image formed in colour photographic material.

In spite of the obvious attractions of using a virtually grain-free monochromatic dye image to produce enlargements and also the concomitant advantage of full silver recovery very little commercial use has been made of the process. This is probably because colour development is required and this is more difficult and expensive to carry out than normal black and white development and the aforesaid advantages of monochrome silver halide material do not outweigh the disadvantages of colour development.

However we have discovered a method of processing monochrome silver halide material of a restricted type in such a way as to obtain greatly increased sharpness of image which combinded with the aforesaid advantages makes the use of monochrome silver halide material very attractive.

Therefore according to the present invention there is provided a method of processing monochrome silver halide material which contains in at least one silver halide layer in addition to the normal image-forming colour coupler or couplers a development inhibitor releasing compound (D.I.R. compound) which method comprises developing the exposed material in a colour developing solution which comprises not more than 2.5 g/liter of a paraphenylene diamine colour developing agent which is able to couple with the colour coupler or couplers and D.I.R. compound present, the process further comprising silver halide fixing, silver image bleaching and washing steps.

Preferably the concentration of the colour developing agent in the colour developing solution is from 1 to 2.5 g/liter and most preferably from 2.0 to 2.4 g/liter.

Preferably the colour development step is about 5 minutes duration and this is followed by a bleach-fix step of about 5 minutes. Preferably this is followed by a water washing step of five minutes.

Most preferably the colour development step is carried out at an elevated temperature, that is to say above 30° C., and most preferably at between 33° to 38° C.

Since the colour developing step is preferably carried out with only intermittent agitation, the method employed is a manual operation rather than a continuous machine process.

The method of the present invention produces negatives exhibiting a high degree of sharpness and a noticeable edge effect.

If the processing is carried out using normal strength colour developing solutions, i.e. containing about 5.0 g/liter of a paraphenylenediamine colour developing agent, but with the material containing a D.I.R. compound, some improvement in sharpness of the image is observed over material which does not comprise a D.I.R. compound, and similarly if the material does not contain a D.I.R. compound but is nevertheless developed in a colour developing solution containing less than 2.5 g/liter of a colour developing agent of the paraphenylenediamine type then some improvement in the sharpness of the image is observed. But when the method of the present invention is employed there is a remarkable increase in sharpness of the developed image which is greater than that expected by the simple additive effects of using material containing a D.I.R. compound and the special colour developing solution.

Preferably the D.I.R. compound is a D.I.R. colour coupler, that is to say a colour coupler which has a D.I. leaving group and this group leaves when the colour coupler couples with the colour developing agent. Examples of D.I.R. colour couplers are given in GB No. 980507 and GB No. 1250318.

Preferably the D.I. group which is released from the D.I.R. compound is an alkyl thiotriazole of the formula

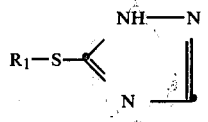

(1)

where $R_1$ is an alkyl group having from 4 to 8 carbon atoms.

More preferably the D.I.R. compound is a colour coupler having as the leaving group an alkyl thiotriazole as just set forth.

Examples of alkyl groups $R_1$ are butyl, pentyl, hexyl, heptyl, octyl and isomers thereof. The hexyl radical is preferred.

Most preferably the D.I.R. compound is a yellow colour coupler having as a leaving group an alkyl thiotriazole as just set forth.

A suitable yellow colour coupler of this type is a benzoyl acetanilide yellow colour coupler of the formula

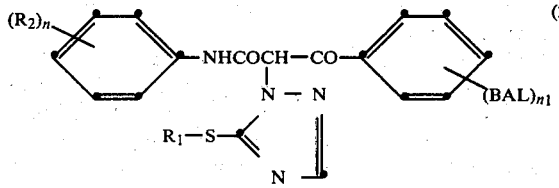

(2)

where $R_1$ is as defined above, $R_2$ is hydrogen, methoxy, fluorine, bromine or dimethylamino, n is 1 or 2, BAL represents a long chain alkyl ballasting group to make the coupler substantive to the layer in which it is coated such as a $—C(CH_3)_2C_2H_5$ group and $n_1$ is 1 or 2.

Most preferably n is 1, $n_1$ is 2 and $R_2$ is chlorine.

A further particularly suitable yellow colour coupler of this type is a pivaloyl acetanilide yellow colour coupler of the formula

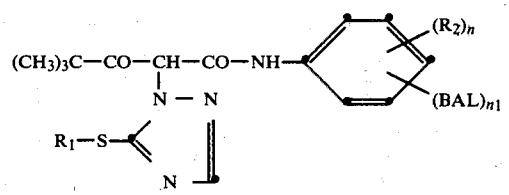

(3)

where $R_1$, $R_2$, n, BAL and $n_1$ have the meanings assigned to them above.

In the above two formulae (2) and (3) the alkylthiotriazole is attached to the colour coupler in the leaving position and is released and acts as a development inhibitor when the colour coupler couples with the paraphenylene diamine colour developing agent to yield a yellow dye.

Examples of other D.I. groups which may be attached to the colour couplers of formulae (2) and (3) in the leaving position are (a) groups of the formula $—S—R_4$ where $R_4$ is an alkyl or aryl group as described in GB No. 953.454; (b) 1-phenyl-5-mercaptotetrazole which has the formula

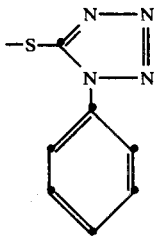

(4)

and (c) 1,2,3-benzotriazolyl groups of the formula

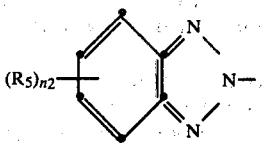

(5)

where $R_5$ represents an alkyl or alkoxy group having 1 to 18 carbon atoms, a 5 or 6 membered carbocyclic or heterocyclic ring or a phenylazo group and $n_2$ is 1 to 3. Compounds of this type are described in GB. No. 1.250.318.

Examples of other D.I.R. compounds which are not colour couplers but which are of use in the material used in the present invention are the compounds claimed in GB Nos. 1.224.555 and 1.484.273 and in published GB patent application No. 2.035.302.

Most preferably the D.I.R. compound is present in the material at a coating weight of from 0.01–0.2 g/m$^2$.

As hereinbefore stated, in monochrome silver halide material it is required to provide a yellowish dye image.

Preferably the yellowish colour coupler of use in the photographic materials is a pivaloyl acetanilide or benzoyl acetanilide yellow coupler.

Pivaloyl acetanilide yellow colour couplers which form a yellowish dye after the coupling reaction are described for example in GB No. 1.078.338.

Benzoyl acetanilide yellow colour couplers which form a yellowish dye after the coupling reaction are described for example in U.S. Pat. No. 2,407,210.

A suitable example of such an pivaloyl acetanilide yellow colour coupler has the general formula

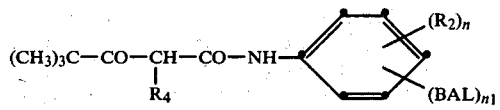

(6)

where $R_4$ is hydrogen, halogen such as bromine or chlorine or a leaving group (including a D.I. group) for example a heterocyclic ring or an —SB radical, wherein B is an alkyl, aryl or heterocyclic group, and $R_2$, n, BAL and $n_1$ are as defined above.

Further examples of suitable yellow colour couplers of formula (6) are given in U.S. Pat. No. 3,265,506 and U.S. Pat. No. 3,384,657.

A suitable example of a benzoyl acetanilide yellow colour coupler has the general formula

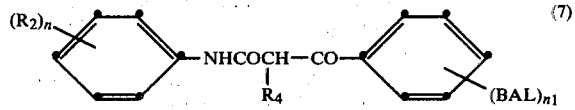

(7)

where $R_2$, n, $R_4$, BAL and $n_1$ have the meanings assigned to them above.

Most preferably the monochrome silver halide material used in the method of the present invention comprises a D.I.R. colour coupler of formula (3) and a pivaloyl yellow colour coupler of formula (6), which forms a yellowish dye after the coupling reaction.

The preferred ratio of D.I.R. yellow colour coupler to yellow colour coupler is 0.05 to 1.0.

According to the EP application No. 25.775 the undesirably high level of fog which often occurs during the colour development of monochrome silver halide material can be minimised by the presence in the material of a more reactive non-yellow colour coupler. According to the above mentioned EP application there is provided a monochrome silver halide material which comprises in a silver halide emulsion layer a colour coupler which couples with oxidised colour developer of the paraphenylene diamine type to produce a yellowish dye which absorbs light in the region of 350 to 560 nm, together with a more reactive (as hereinafter defined) coupler compound which reacts with oxidised colour developer of the paraphenylene diamine type to yield a dye of which the absorption is predominantly above 560 nm, the ratio of coupler which produces a yellowish dye to reactive coupler being from 10:0.1 to 10:2.0, the parts being by weight.

By a dye the absorption of which is predominantly above 560 nm is meant that at least 90% of the absorption is about 560 nm. Usually a reactive coupler is chosen which couples to produce a dye the absorption of which is all above 560 nm, but it is sometimes desirable, in order to increase the density of the image, that some of the absorption is below 560 nm.

The term "more reactive coupler" as used hereinafter means a coupler which couples more readily with oxidised colour developer than the yellow couplers also present in the same layer and which produces a dye which absorbs above 560 nm. A test to illustrate comparative reactivities of coupler compounds is set forth hereinafter.

Most preferably the more reactive coupler is a cyan colour coupler. The reaction product of a cyan colour coupler and oxidised colour developer is a dye which absorbs in the region of 620–690 nm, i.e. above 560 nm.

Because it is difficult for an operator making photographic enlargements to bring into focus a film having only a yellow image it is preferred that there is present in the silver halide emulsion layer which comprises the yellowish colour coupler and the more reactive coupler compound a further amount of a coupler or a mixture of couplers which produce with the yellowish coupler either a green image or most preferably a brown image. Thus there may be present a cyan colour coupler which is either no more reactive than the yellowish colour coupler or is less reactive. When such a cyan coupler is present the preferred ratios of the three compounds yellowish colour coupler, cyan coupler and more reactive coupler compound are 10:(2 to 4):(0.1 to 2.0). This produces a green final image. In order to produce a brown final image it is necessary to have present in the silver halide emulsion layer which comprises the other couplers a magenta coupler as well. This magenta coupler should be either less reactive or no more reactive than the yellowish coupler. When such a magenta coupler is present the preferred ratios of the four compounds yellowish colour coupler, magenta colour coupler, cyan colour coupler and more reactive coupler compound are 10:(2 to 4):(2 to 4):(0.1 to 2.0). Most preferably in this case the more reactive coupler compound is also a cyan colour coupler.

The preferred monochrome silver halide material of use in the method of the present invention may also comprise this mixture of colour couplers and preferably does so.

Thus a preferred silver halide photographic material comprises in at least one silver halide emulsion layer a yellowish colour coupler, a less reactive cyan colour coupler, a magenta colour coupler, a more reactive cyan colour coupler and a yellow D.I.R. colour coupler in the ratios 10:(2 to 4):(2 to 4):(0.5 to 1.5):(0.1 to 0.6).

The preferred silver halide photographic material has a silver coating weight of from 6 to 8.5 g/m$^2$ and a yellowish colour coupler coating weight of from 1.0 to 3.0 g/m$^2$.

When such material is processed in the areas of very low exposure or no exposure only small amounts of oxidised developer will be produced and most of this will be due to fog, that is to say latent image caused by factors other than imagewise exposure. In such areas the colour couplers will compete for such oxidised developer as has been produced and the most reactive colour coupler will take the major share of this oxidised colour developer. Thus when the photographic material used in the process is of the preferred type, that is to say when the more reactive coupler is a cyan coupler, the fog region becomes cyan. As cyan does not absorb blue light it is in effect invisible to the printing paper used to prepare prints from a negative prepared by the process of the present invention. However the inclusion of too much active cyan colour coupler in the silver halide emulsion layer of the photographic material causes an unacceptable loss of speed as it will compete with the yellowish colour coupler in the areas in which a yellow image should be formed.

However, preferably as hereinbefore stated, there is also present in the silver halide emulsion layer a lesser amount, compared with the amount of yellowish colour coupler, of a less reactive cyan coupler and a magenta colour coupler. These couplers will compete with the yellowish colour coupler and a brown dye image will be formed in the imagewise exposed areas. As stated the photographic silver halide printing paper "sees" only the blue-green absorbing component (yellowish dye) of the brown image. The red absorbing components (cyan dye and magenta dye) of the brown image are formed to provide greater visual contrast of the dye image in the negative to enable the user to focus the image more easily on to the printing paper.

However in the monochrome silver halide material used in the method of the present invention there is present a D.I.R. compound and preferably a D.I.R. coupler. Thus in the method of the present invention when there is present in the monochrome silver halide material a more reactive coupler, the presence of the more reactive coupler minimises the release of D.I. compound in the fog region. However D.I. compound is released from the D.I.R. coupler in areas of higher exposure. This results in a more contrasty image in the low exposure regions and an increase in edge effect in high exposure regions where maximum compensation for sharpness loss due to scatter is required. This increase in sharpness is very greatly increased by using as a colour developing solution a colour developing solution which comprises not more than 2.5 g/liter of a paraphenylene diamine developing agent.

Thus in the processed material produced by the method of the present invention and using the preferred monochrome silver halide material the yellowish colour coupler, magenta colour coupler and the yellow D.I.R. coupler all contribute to the yellow-orange component of the brown dye image which is visible to printing paper whilst the more reactive cyan coupler and the less reactive cyan coupler both contribute to the cyan component of the brown dye image, whilst a cyan dye image is formed in the fog region.

In one embodiment of the photographic material of use in the present invention the photographic material comprises two silver halide emulsion layers, each layer comprising a yellowish colour coupler and a more reactive coupler, however on processing a similar monochromatic image is formed in each silver halide emulsion layer. Preferably each silver halide emulsion layer contains the same mixture of the five types of colour coupler as hereinbefore set forth. Most preferably however the silver halide/coupler ratio of the silver halide present in the two layers is different. Also the photographic speed of each layer is different.

Thus the top layer in the assembly contains a high speed silver halide emulsion and the lower layer a low speed silver halide emulsion. This combination gives extended sensitivity to the total assembly so that subjects with an extended luminence range can be satisfactorily reproduced, and good overexposure latitude is achieved. The silver halide/coupler ratio in the two layers is preferably different. In the high speed layer the ratio is higher than in the lower speed layer. The high ratio gives low granularity in the high speed layer and the low ratio gives good tone reproduction in the low speed layer where granularity is less important.

Preferably in the photographic material of the present invention the or both silver halide layers are optically sensitised by means of optical sensitising dyes and most preferably the or both silver halide layers are panchromatically sensitised, that is to say have a sensitivity from 400 to 700 nm, the whole useful range of the visible spectrum.

Particularly suitable reactive cyan couplers of use in the photographic material of the present invention are naphthol cyan colour couplers of the formula

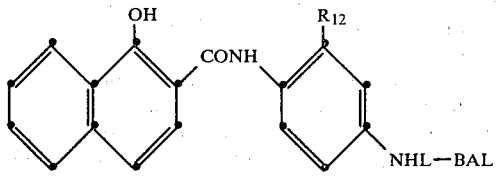

(8)

where $R_{12}$ is hydrogen, halogen or alkoxy, L is a linking group such as $—COCH_2—$ and BAL represents a ballasting group, for example a phenoxy radical substituted in 2 and 4-position by $—C(CH_3)_2C_2H_5$ groups.

Examples of naphthol cyan colour couplers of formula (8) are given in GB No. 1.543.040.

Examples of useful less reactive cyan couplers for use in the photographic material of the present invention are given for example in DE No. 1.137.311.

However the preferred less reactive cyan couplers are those which on coupling yield a dye whose maximum absorption is below 700 nm. Thus preferably a phenolic cyan colour coupler and not a naphthoic colour coupler is used.

A useful class of phenolic cyan colour couplers for this purpose are those of the formula

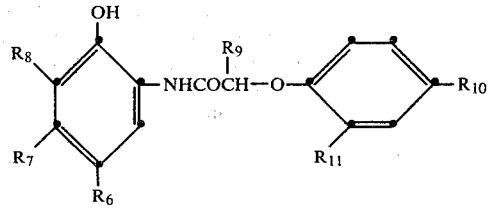

(9)

wherein $R_6$ is hydrogen or halogen, $R_7$ and $R_8$ are each hydrogen, halogen or alkyl groups having from 1 to 4 carbon atoms, $R_9$ is hydrogen or an alkyl group having from 1 to 4 carbon atoms and $R_{10}$ and $R_{11}$ are each alkyl groups having from 5 to 10 carbon atoms.

Examples of alkyl groups $R_7$, $R_8$ and $R_9$ are those described above for $R_1$. Alkyl groups $R_{10}$ and $R_{11}$ are for example pentyl, hexyl, octyl and decyl as well as branched chain isomers thereof.

A large number of magenta colour couplers are of use in the photographic material of the present invention. Exemplary of such magenta colour couplers are those described in U.S. Pat. No. 2,908,573 and GB No. 680.488 and GB No. 1.129.333.

Particularly suitable magenta colour couplers are those described in GB No. 965.721 which are of the formula

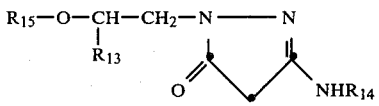

(10)

where $R_{15}$ is a hydrogen atom or a (carboxylic acid) acyl group, $R_{14}$ is a (carboxylic acid) acyl group and $R_{13}$ is hydrogen, alkyl having 1 to 4 carbon atoms, phenyl or substituted phenyl.

Preferably all the colour couplers are present in the silver halide emulsion layer (or layers) as an oil dispersion. The couplers may be prepared and added in a single oil dispersion or may be added as separate oil dispersions.

The photographic material of the present invention may be coated on any of the usual transparent film bases including cellulose triacetate, cellulose acetate-butyrate and subbed and oriented polyethylene terephthalate.

The preferred colour developing agents for use in the present invention are the paraphenylene diamine compounds of the formula

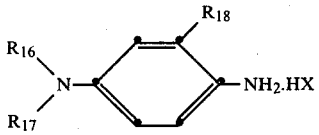

(11)

where $R_{16}$ and $R_{17}$ are each alkyl groups having from 1 to 6 carbon atoms or substituted alkyl groups, $R_{18}$ is hydrogen or an alkyl group having from 1 to 4 carbon atoms or substituted alkyl group, and X is an anion.

Examples of substituted alkyl groups are alkoxy alkyl groups and alkyl sulphonamidoalkyl.

Preferably $R_{16}$ and $R_{17}$ are each ethyl or one is ethyl and the other is substituted ethyl, for example hydroxyethyl.

Examples for X are halides, sulphate ($SO_4^{2-}/2$) and hydrogensulphate ($HSO_4$—).

Examples of suitable commonly available colour developing agents of use in the present invention are set forth in "Photographic Processing Chemistry" by L. F. A. Mason, Focal Press, 1977, pp. 234–235.

Preferably the silver halide used is an iodobromide silver halide having a halide ratio of from 1.5 to 10% of iodide to bromide.

Preferably the silver halide is panchromatically sensitised to both the green and red regions of the visible spectrum using optical sensitising dyes.

The silver halide emulsion may be chemically sensitised by sulphur and/or gold sensitisers and also by polyethylene oxide compounds or by other chemical sensitising agents used to sensitise high speed camera film emulsions.

The silver halide emulsion may be stabilised by the presence of stabilising compounds used to stabilise such emulsions, such as tetraazaindene compounds and mercaptotriazole compounds.

The binder for the silver halide crystals in the silver halide emulsion if preferably gelatin, but so-called gelatin extenders may be present such as acrylamides and polyvinyl alcohol. Latex polymers may also be present such as latex polymers derived from alkyl acrylates and methacrylates.

The binder may be hardened using any of the well known hydrophilic colloid binders such as formaldehyde, glyoxal and triazine derivatives.

The accompanying Example will serve to illustrate the invention.

EXAMPLE

Couplers used:

(101) Yellow coupler (which yields a yellowish colour after the coupling reaction)

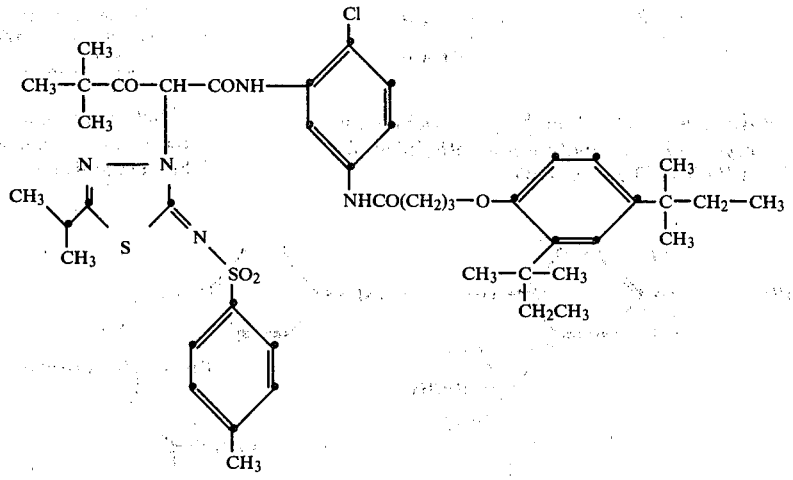

5-{γ-[2,4-Bis(1,1-dimethylpropyl)phenoxy]-butyramido}-2-chloro-α-[5-isopropyl-2-(4-tolylsulphonylimino)-$\Delta^4$-1,3,4-thiadiazolin-3-yl]-α-pivalylacetanilide (102) Magenta Coupler

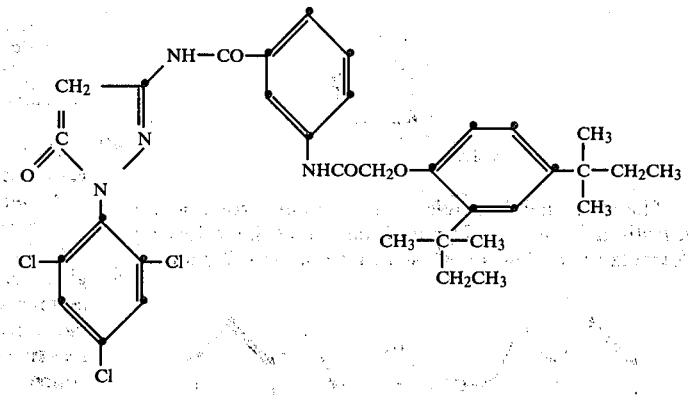

3-{3-[(2,4-Bis[1,1-dimethylpropyl]phenoxy)acetamido]benzamido}-1-(2,4,6-trichlorophenyl)-2-pyrazolin-5-one (103) Cyan Coupler (more reactive)

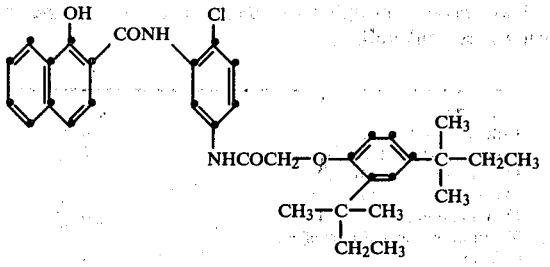

2-{5-[(2,4-Bis(1,1-dimethylpropyl)phenoxy)acetamido]-2-chlorophenylcarbamoyl}-1-naphthol (104) Cyan Coupler (less reactive)

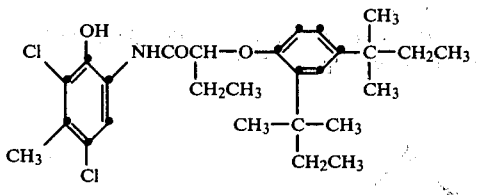

6-{α-[2,4-Bis-(1,1-dimethylpropyl)phenoxy]-butyramido}-2,4-dichloro-3-methylphenol (105) Yellow D.I.R. Coupler

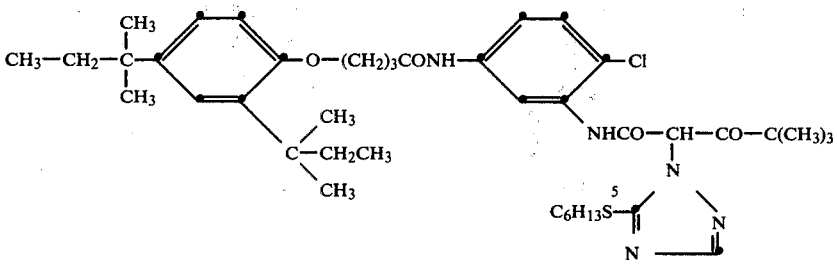

5-{α-2,4-Bis)1,1-dimethylpropyl)phenoxy butyramido}-2-chloro-α-(3-hexylthio-1,2,4-triazol-1-yl-α-pivalylacetanilide The D.I.-moiety of the yellow D.I.R. coupler may also be written as the isomeric species:

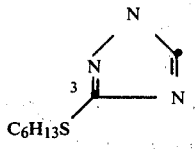

The silver halide emulsion used is panchromatically sensitised by use of 0.15 mg of the dye of the following formula which has a peak sensitivity at 580–620 nm.

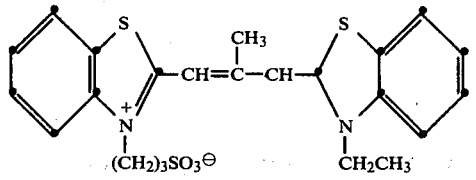

Anhydro-(3-ethyl-2-benzothiazole) [3-(3-sulphopropyl)-2-benzothiazole]-β-methylthrimethincyanine hydroxide.

Two colour coupler oil dispersions are prepared using a colloid mill.

| Dispersion 1 | |
|---|---|
| Colour coupler (101) | 6 g |
| Colour coupler (102) | 2 g |
| Colour coupler (103) | 0.5 g |
| Colour coupler (104) | 1.5 g |
| (Total couplers) | (10 g) |
| Tri-isopropylphenyl phosphate | 7.5 g |
| Gelatin | 4 g |
| Ethyl acetate | 5 g |

-continued

| | |
|---|---|
| Sodium alkyl naphthalene sulphonate | 10 ml |
| Nonyl phenol ethylene oxide condensate | 0.5 g |
| Water to | 100 g |
| Dispersion 2 | |
| Colour coupler (105) | 10 g |
| Tri-isopropylphenyl phosphate | 10 g |
| Gelatin | 4 g |
| Ethyl acetate | 10 g |
| Sodium alkyl naphthalene sulphonate | 10 ml |
| Nonyl phenol ethylene oxide condensate | 0.5 ml |
| Water to | 100 g |

Sufficient quantities of Dispersions 1 and 2 are added with hand stirring at 40° C. to an aqueous gelatino silver halide emulsion so that when the emulsion is coated on cellulose triacetate base and dried the coating weights of each ingredient per 1 $dm^2$ are as follows:

| | | |
|---|---|---|
| Gelatin | 41 mg | |
| Silver iodobromide | 40 mg | (of silver) |
| Colour coupler (101) | 24 mg | |
| Colour coupler (102) | 8 mg | |
| Colour coupler (103) | 2 mg | |
| Colour coupler (104) | 6 mg | |
| Colour coupler (105) | 0.15 mg | |

Over the coated silver halide emulsion layer there is coated a gelatin protective layer.

A second photographic assembly is prepared as above except that no D.I.R. coupler is used and therefore the quantities of the other couplers are reduced to give coating weights per 1 $dm^2$ of 15 mg of yellow coupler (101), 5 mg of magenta coupler (2), 1.25 mg of more reactive cyan coupler (3) and 3.75 mg of less reactive cyan coupler (4), in order to produce the same contrast for the same development time as with the first assembly. The same quantities of silver and gelatin were employed as in the first assembly.

After exposing the samples of the two assemblies to a square-wave sharpness chart they are processed as follows at 37.8° C.

| | | |
|---|---|---|
| 1. | Colour developing | 3¼ mins. |
| | Developer bath: | |
| | Potassium carbonate | 37.5 g |
| | Sodium sulphite (anhydrous) | 4.25 g |
| | Potassium iodide | 2.0 mg |
| | Sodium bromide | 1.3 g |
| | Hydroxylamine sulphate | 2.0 g |
| | 4-(N—ethyl-N—β-hydroxyethylamino)-2-methylaniline hydrogen sulphate | 4.75 g |
| | Diethylenetriamine penta-acetic acid | 2.2 g |
| | Water to | 1 liter |
| 2. | Bleaching | 6½ mins. |
| | Bleach bath: | |
| | Ammonium bromide | 150 g |
| | Ammonium salt of the iron-III-complex | 175 ml |

-continued

| | | |
|---|---|---|
| | of ethylenediamine tetra-acetic acid (1.47M) | |
| | Acetic acid | 10 ml |
| | Sodium nitrate | 35 g |
| | Water to | 1 liter |
| 3. | Washing | 3¼ mins. |
| 4. | Fixing | |
| | Fix bath: | |
| | Ammonium thiosulphate | 162 ml |
| | Diethylenetriamine penta-acetic acid | 1.25 g |
| | Sodium metabisulphite (anhydrous) | 12.4 g |
| | Sodium hydroxide | 2.4 g |
| | Water to | 1 liter |
| 5. | Washing | 3½ mins. |
| 6. | Stabilising | |
| | Stabiliser bath: | |
| | Formaldehyde (35%) | 5.0 ml |
| | Sodium alkyl aryl polyether sulphate | 1 ml |
| | Water to | 1 liter |

Two further samples of the two assemblies, one with the D.I.R. coupler and one without, are exposed and processed as just set forth except that in the colour developing bath the amount of the colour developer 4-(N-ethyl-N-β-hydroxyethylamino)-2-methylaniline hydrogen sulphate is only 2.4 g/liter, approximately half the concentration of the first colour developer solution. The development time is extended to 5 minutes in order to obtain a similar contrast to that obtained with the full conentration of developing agent.

The line- and space-densities of the reproduced sharpness charts are measured with a scanning microdensitometer fitted with a blue filter in order to match the response of black and white printing paper. The sharpness response at the important frequency of 10 lines per mm is expressed as:

$$\frac{\left[\dfrac{\text{Average line density} - \text{average space density of reproduction}}{\text{Average line density} - \text{average space density of original}}\right]_{10\ l/\text{mm}}}{\left[\dfrac{\text{Average line density} - \text{average space density of reproduction}}{\text{Average line density} - \text{average space density of original}}\right]_{0.4\ l/\text{mm}}}$$

This is referred to as the density transfer function (DTF). "−" means "minus".

The higher the DTF figure the better the sharpness.

| | Results | |
|---|---|---|
| | DTF | |
| Sample | Developer with 4.75 g of M.S. | Developer with 2.4 g of M.S. |
| with DIR | 0.88 | 1.01 |
| without DIR | 0.87 | 0.95 |

(M.S. is 4-(N-ethyl-N-β-hydroxyethylamino)-2-methylaniline hydrogensulphate)

This shows that the combination of a coating containing D.I.R. coupler with a developer containing half the usual concentration of colour developing agent gives an improvement in sharpness which is greater than the sum of the improvements produced by either modification alone.

Test for coupler reactivity

A mixture of oil-dispersed the yellow-forming couplers (101) and (105) is prepared in the ratio 25:1.5 by weight respectively. To 26.5 mg aliquots are added 11 mg aliquots of test coupler. A reference sample is prepared by adding 11 mg of cyan coupler (104) to a 26.5 ml aliquot of (101) and (105).

Each mixture is dispersed in 65 mg of silver as silver halide emulsion from Example 1 and coated on a 1 $dm^2$ glass plate.

The plates are exposed to a wedge, colour processed in the usual way and the blue densities determined using a densitometer which is insensitive to red light. Preferred reactive couplers are those which give a reduction in yellow fog of at least 50%. In the results below coupler (106) as shown hereinafter is more reactive than the control but gives insufficient density reduction. The mixture containing coupler (103) shows it to be more reactive and of the preferred type for this invention.

| | Fog | D-max |
|---|---|---|
| Coupler mixture | | |
| [(101) + (105)] Control | 0.43 | 2.05 |
| [(101) + (105)] + (104) | 0.40 | 2.11 |
| [(101) + (105)] + (106) | 0.30 | 1.82 |
| [(101) + (105)] + (103) | 0.15 | 1.79 |
| Cyan Coupler (106) | | |

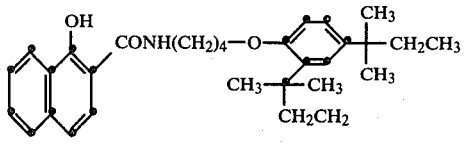

2-{4-[2,4-Bis(1,1-dimethylpropyl)phenoxy]butylcarbamoyl}-1-naphthol.

I claim:

1. A method of processing monochrome silver halide material which contains in at least one silver halide layer in addition to the normal image-forming colour coupler or couplers, a development inhibitor releasing compound which method comprises developing the exposed material in a color developing solution which comprises not more than 2.5 g/liter of a paraphenylene diamine colour developing agent of the formula

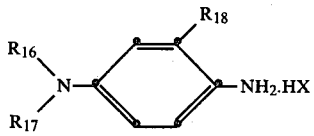

where $R_{16}$ is alkyl having from 1 to 6 carbon atoms or substituted alkyl, $R_{17}$ is substituted alkyl, $R_{18}$ is hydrogen or alkyl having from 1 to 4 carbon atoms or substituted alkyl, and X is an anion, which colour colour developing agent is able to couple with the colour coupler or couplers and D.I.R. compound present, the D.I. group being an alkyl thiotriazole group of the formula

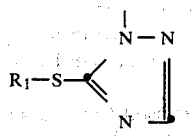

where $R_1$ is an alkyl group having from 4 to 8 carbon atoms, the process further comprising silver halide fixing, silver image bleaching and washing steps.

2. A method according to claim 1 wherein the concentration of the colour developing agent in the colour developing solution is from 1 to 2.5 g/liter.

3. A method according to claim 1 wherein the colour development step is carried out at a temperature above 30° C.

4. A method according to claim 1 wherein the D.I.R. compound is a colour coupler which releases a D.I. group.

5. A method according to claim 4 wherein the colour coupler is a yellow colour coupler.

6. A method according to claim 1 wherein the D.I.R. compound is present in the material at a coating weight of from 0.01 to 0.2 g/m$^2$.

7. A method according to claim 1 wherein the main image forming coupler in the material is a yellow colour coupler.

8. A method according to claim 1 wherein the main image forming couplers in the material are a yellow colour coupler and a yellowish dye forming colour coupler.

9. A method according to claim 8 wherein the material also comprises cyan couplers and a magenta coupler.

* * * * *

UNITED STATES PATENT AND TRADEMARK OFFICE

CERTIFICATE OF CORRECTION

PATENT NO. : 4,368,255

DATED : January 11, 1983

INVENTOR(S) : Thomas G. Borg

It is certified that error appears in the above-identified patent and that said Letters Patent is hereby corrected as shown below:

Col. 1, line 68 — Delete "combinded" and insert --combined--

Col. 4, line 5 — Delete

" 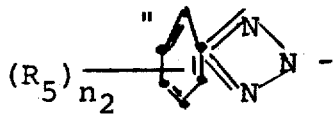 "

and insert

-- 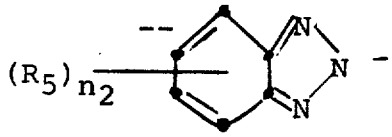 --

Col. 4, line 33 — After "such" delete "an" and insert --a--

Col. 10, line 40 (Beginning of Structure) — Delete

" 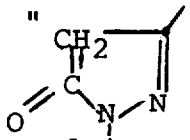 "

and insert

-- 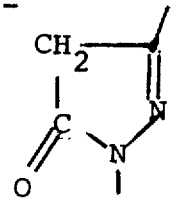 --

UNITED STATES PATENT AND TRADEMARK OFFICE

CERTIFICATE OF CORRECTION

PATENT NO. : 4,368,255

DATED : January 11, 1983

INVENTOR(S) : Thomas G. Borg

It is certified that error appears in the above—identified patent and that said Letters Patent is hereby corrected as shown below:

Col. 13, line 29 — Delete "conentration" and insert --concentration--

Col. 14, line 30 (Middle-bottom of structure) — Delete

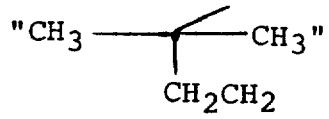

and insert

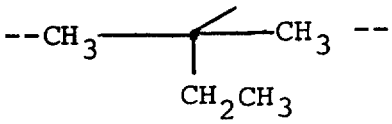

Col. 14, line 65 — After "which" delete "colour colour" and insert --colour coupler--

Signed and Sealed this

Seventeenth Day of May 1983

[SEAL]

Attest:

DONALD J. QUIGG

Attesting Officer

Acting Commissioner of Patents and Trademarks